United States Patent [19]

Nagel et al.

[11] 4,135,953

[45] * Jan. 23, 1979

[54] PERMANENT MAGNET AND METHOD OF MAKING IT

[75] Inventors: Hartmut Nagel, Wettingen; Roger Perkins, Oberrohrdorf, both of Switzerland

[73] Assignee: BBC Brown, Boveri & Company, Limited, Baden, Switzerland

[ * ] Notice: The portion of the term of this patent subsequent to Mar. 28, 1995, has been disclaimed.

[21] Appl. No.: 829,205

[22] Filed: Aug. 30, 1977

Related U.S. Application Data

[63] Continuation-in-part of Ser. No. 722,121, Sep. 10, 1976, Pat. No. 4,081,297.

[51] Int. Cl.[2] ..... H01F 1/02

[52] U.S. Cl. ..... 148/103; 75/152; 148/31.57; 148/105; 148/108

[58] Field of Search ..... 75/152, 200, 214, 245; 148/101, 103, 31.57, 105, 108, 126

[56] References Cited

U.S. PATENT DOCUMENTS

| | | | |
|---|---|---|---|
| 3,102,002 | 8/1963 | Wallace et al. | 75/152 |
| 3,421,889 | 1/1969 | Ostertag et al. | 75/152 |
| 3,540,945 | 11/1970 | Strnat et al. | 148/103 |
| 3,615,915 | 10/1971 | Luiten et al. | 148/103 |
| 3,684,593 | 8/1973 | Benz et al. | 148/103 |
| 3,928,971 | 9/1976 | Yamanaka et al. | 148/101 |

FOREIGN PATENT DOCUMENTS

| | | | |
|---|---|---|---|
| 2017234 | 7/1971 | Fed. Rep. of Germany | 148/101 |

OTHER PUBLICATIONS

Johnson et al.; "Preparation of RE–Co Permanent Magnets by a Simplified Technique," COBALT 53 (12/71), pp. 191–196.

*Primary Examiner*—Arthur J. Steiner

*Attorney, Agent, or Firm*—Oblon, Fisher, Spivak, McClelland & Maier

[57] ABSTRACT

A rare earth permanent magnet comprising an alloy consisting essentially of:

$$RE_2(CO_{1-x-y}Fe_xTM_y)_{17+z}$$

wherein:

RE is at least one rare earth element;

TM is at least one transition element selected from the group consisting of chromium, manganese, titanium, tungsten and molybdenum;

$-2 \leqq z \leqq 1$;

$0.5 < (1-x-y) < 1$ $0.05 \leqq x \leqq 0.4$ $0.01 \leqq y \leqq 0.2$ wherein said rare earth permanent magnet is further characterized by possessing high values of coercive field strength, an ideal demagnetization curve and a remanence of more than 9KG and wherein said rare earth permanent magnet is prepared by the process which comprises mixing together a starting alloy of the composition $RE_2(Co_{1-x-y}Fe_xTM_y)_{17+z}$ and 8 to 14 wt.% of a samarium-rich sinter additive compound composed of 50–60 wt.% samarium and 40–50 wt.% of an alloy $Co_{1-x-y}Fe_xTM_y$ wherein both said starting alloy and said sinter additive are each in powder form of average grain size 2.0 to 10μm; magnetically aligning the mix; compressing it to a greenling; sintering it to form a magnet; and subjecting said magnet to a heat treatment to 400° C - 600° C.

10 Claims, No Drawings

PERMANENT MAGNET AND METHOD OF MAKING IT

CROSS REFERENCE TO RELATED APPLICATION

This application is a continuation-in-part of application Ser. No. 722,121, filed Sept. 10, 1976 and now U.S. Pat. No. 4,081,297.

BACKGROUND OF THE INVENTION

1. Field of the Invention

The present invention relates to a permanent magnet composed of at least one rare earth element and other elements, including cobalt, as well as a method of making it.

2. Description of the Prior Art

Permanent magnets of the above-mentioned type which are based on $SmCo_5$ and $CeMMCo_5$ are known. High coercive fields are attainable with these. However, their magnetic remanence is below 10KG in all cases.

For many uses, a lower coercive field and a higher magnetic remanence with, at the same time, an ideal demagnetization curve are required. Consequently, it is most desirable to improve rare earth-cobalt magnets so as to obtain, along with a high coercive field, a magnetic remanence of more than 9KG.

SUMMARY OF THE INVENTION

Accordingly, it is an object of this invention to provide a rare earth-cobalt magnet which simultaneously possesses high values of coercive field strength and remanence as well as an ideal demagnetization curve.

Briefly, this and other objects of this invention as will hereinafter become clear, have been attained by including along with at least one rare earth element and cobalt, the elements iron and at least one of the transition metals (TM) selected from the group consisting of chromium, manganese, titanium, tungsten and molybdenum wherein approximately 17 moles of all elements other than the rare earths are present for every 2 moles of the rare earths (RE).

DETAILED DESCRIPTION OF THE PREFERRED EMBODIMENTS

To make the permanent magnets of this invention, a powder, with a mean grain size from 2.0 to 10 μm, of a starting alloy of composition $RE_2(Co_{1-x-y}Fe_xTM_y)_{17+z}$ is mixed with from 8 to 14 wt.% of a samarium-rich sinter additive (composed, for example, of 50–60 wt.% of samarium and 40–50 wt.% of the alloy $Co_{1-x-y}Fe_xTM_y$) wherein $-2 \leqq z \leqq 1$; $0.5 < (1-x-y) < 1$; $0 < x \leqq 0.4$; $0 < y < 0.2$, preferably $0.05 \leqq x \leqq 0.4$ and $0.01 \leqq y \leqq 0.2$. The mixture is magnetically aligned, compressed to a greenling and sintered to form a magnet. The magnet is subsequently subjected to a heat treatment above 400° C.

The permanent magnets of this invention, in contrast to known magnets, e.g., Alnico, exhibit a much higher coercive field and yet have a comparable remanence and an ideal demagnetization curve.

Preferred rare earths are (1) samarium and (2) a mixture of samarium and a light rare earth element from atomic elements 57–62, misch metal or mixtures thereof.

In the making of the permanent magnets of this invention, the following basic procedure is advantageous. A quantity of the desired $RE_2(Co_{1-x-y}Fe_xTM_y)_{17+z}$ starting alloy, i.e., from 92–86 wt.%, on the one hand, and from 8-14 wt.% of a samarium-rich sinter additive Sm/(Co,Fe,TM) on the other, are each melted together from their individual alloy components. The sinter additive should contain 50 to 60 wt.% of samarium. The proportion of Co:Fe:TM in the sinter additive is preferably the same as that of the starting alloy. The sinter additive creates, in a known way, particularly favorable sintering conditions. It does not figure quantitatively in the magnetic end-alloy, since, by appropriate selection, it only compensates the oxide losses occurring during the production process.

The fused starting alloy is subjected to a stabilizing annealing treatment at about 1150° C. for about 6 hours, i.e., at a temperature below the liquidus temperature. The starting alloy, thus annealed, and the fused sinter additive are crushed to a grain size of ≦ 1mm. The crushed starting alloy is then mixed with 8 to 14 wt.% of the crushed sinter additive and the mixture reduced to a powder of average grain size from 2.0 to 10 μm, desirably from 2.0–5.0 μm, preferably less than 3 μm, in a counter-jet mill. There can also be used, in place of the counter-jet mill, an attritor or a ball mill. The two alloys can also be ground separately and the powders subsequently mixed in the correct ratio.

The powder is next magnetically aligned in a pressing die and compressed isostatically or uniaxially to a greenling with pressures up to 8000 atm. The greenling is then sintered at temperatures between 1110° C. and 1180° C. in a protective gas atmosphere. After the sintering, its density should be at least 92% of the theoretical density.

Next the magnet is advantageously subjected to homogenization annealing at temperatures between 900° C. and 1100° C., preferably 1000°–1100° C., and cooled to room temperature. After cooling, it is tempered at 400° C. to 600° C. and finally magnetized. The tempering is particularly important. The heating and cooling rates used during tempering are relatively irrelevant to the magnetic properties of this type of alloy unless exaggerated values lead to mechanical destruction of the magnet by thermal stresses. Regarding the heating time, values of 1 hour up to a maximum of 300 hours are suitable, the range of 80 to 100 hours being preferred. The resultant products typically have a predominantly single-phase structure.

Having generally described the invention, a more complete understanding can be obtained by reference to certain specific examples, which are included for purposes of illustration only and are not intended to be limiting unless otherwise specified.

The demagnetization curves of the finished permanent magnets of the Examples were obtained in the field of a superconducting solenoid at a maximum field strength of 50 KOe.

EXAMPLES FOR A VARIABLE Z

EXAMPLE 1

Starting alloy: 100g of $Sm_2(Co_{0.8}Fe_{0.125}Mn_{0.05}Cr_{0.025})_{16.5}$

Sinter additive: 10g of (Sm 60 wt.%, Co 32 wt.%, Fe 6 wt.%, Mn 2 wt.%)

Grain size: 2.7 μm

Sinter temperature: 1140° C.

No homogenization annealing

Tempering temperature/time: 500° C./30 hours

Result:

remanence Br = 10.3KG
coercive field strength $_JH_C$ = 10.6KOe

EXAMPLE 2

Starting alloy: 100g of $Sm_2(Co_{0.8}Fe_{0.125}Mn_{0.05}Cr_{0.025})_{17.0}$
Sinter additive: 10g of (Sm 60 wt.%, Co 32 wt.%, Fe 6 wt.%, Mn 2 wt.%)
Grain size: 2.6 μm
Sinter temperature: 1145° C.
No homogenization annealing
Tempering temperature/time: 500° C./80 hours
Result:
remanence Br = 10.2KG
coercive field strength $_JH_C$ = 6KOe

EXAMPLE 3

Starting alloy: 100g of $Sm_2(Co_{0.8}Fe_{0.125}Mn_{0.05}Cr_{0.025})_{17.5}$
Sinter additive: 10g of (Sm 60 wt.%, Co 32 wt.%, Fe 6 wt.%, Mn 2 wt.%)
Grain size: 2.8 μm
Sinter temperature: 1145° C.
No homogenization annealing
Tempering temperature/time: 500° C./70 hours
Result:
remanence Br = 9.3KG
coercive field strength $_JH_C$ = 2KOe

EXAMPLE 4

Starting alloy: 100g of $Sm_2(Co_{0.8}Fe_{0.125}Mn_{0.05}Cr_{0.025})_{16.0}$
Sinter additive: 10 g of (Sm 60 wt.%, Co 32 wt.%, Fe 6 wt.%, Mn 2 wt.%)
Grain size: 2.6 μm
Sinter temperature: 1135° C.
No homogenization annealing
Tempering temperature/time: 500° C./60 hours
Result:
remanence Br = 9.5KG
coercive field strength $_JH_C$ = 3KOe

EXAMPLES FOR A VARIABLE MANGANESE, CHROMIUM AND COBALT CONTENT

EXAMPLE 5

Starting alloy: 100g of $Sm_2(Co_{0.8}Fe_{0.1}Mn_{0.1})_{17}$
Sinter additive: 10g of (Sm 60 wt.%, Co 32 wt.%, Mn 4 wt.%, Fe 4 wt.%)
Grain size: 2.5 μm
Sinter temperature: 1135° C.
No homogenization annealing
Tempering temperature/time: 500° C./77 hours
Result:
remanence Br = 11KG
coercive field strength $_JH_C$ = 1.8KOe

EXAMPLE 6

Starting alloy: 100g of $Sm_2(Co_{0.85}Fe_{0.125}Cr_{0.025})_{17}$
Sinter additive: 11g of (Sm 60 wt.%, Co 34 wt.%, Fe 5 wt.%, Cr 1 wt.%)
Grain size: 2.8 μm
Sinter temperature: 1140° C.
No homogenization annealing
Tempering temperature/time: 500° C./130 hours
Result:
remanence Br = 9.8KG
coercive field strength $_JH_C$ = 3.7KOe

EXAMPLE 7

Starting alloy: 100 g of $Sm_2(Co_{0.75}Fe_{0.225}Cr_{0.025})_{17}$
Sinter additive: 12g of (Sm 60 wt.%, Co 30 wt.%, Fe 9 wt.%, Cr 1 wt.%)
Grain size: 2.6 μm
Sinter temperature: 1150° C.
Homogenization temperature/time: 1060° C./4 hours
Tempering temperature/time: 500° C./60 hours
Result:
remanence Br = 9.8KG
coercive field strength $_JH_C$ = 4.2KOe

EXAMPLES FOR VARIABLE HOMOGENIZATION TEMPERATURES

EXAMPLE 8

Starting alloy: 100g of $Sm_2(Co_{0.8}Fe_{0.15}Cr_{0.05})_{17}$
Sinter additive: 10g of (Sm 60 wt.%, Co 32 wt.%, Fe 4 wt.%, Cr 4 wt.%)
Grain size: 2.5 μm
Sinter temperature: 1140° C.
No homogenization annealing
Tempering temperature/time: 500° C./200 hours
Result:
remanence Br = 9.4KG
coercive field strength $_JH_C$ = 8.2KOe

EXAMPLE 9

Same as Example 9
Homogenization temperature/time: 980° C./1 hour
Tempering temperature/time: 500° C./200 hours
Result:
remanence Br = 9.3KG
coercive field strength $_JH_C$ = 7KOe

EXAMPLE 10

Same as Examples 9 and 10
Homogenization temperature/time: 1060° C./1 hour
Tempering temperature/time: 500° C./200 hours
Result:
remanence Br = 9.4KG
coercive field strength $_JH_C$ = 8.8KOe As can be seen from Examples 9–11, homogenization annealing after sintering does not have as strong an influence as does tempering. However, positive results are obtained when the homogenization annealing is carried out at temperatures above 980° C. and below the sintering temperature.

EXAMPLES FOR VARIABLE TEMPERING TEMPERATURES

EXAMPLE 11

Starting alloy: 100g of $Sm_2(Co_{0.8}Fe_{0.15}Cr_{0.05})_{17}$
Sinter additive: 10g of (Sm 60 wt.%, Co 32 wt.%, Fe 4 wt.%, Cr 4 wt.%)
Grain size: 2.7 μm
Sinter temperature: 1130° C.
No homogenization annealing
Tempering temperature/time: none
Result:
remanence Br = 9KG
coercive field strength $_JH_C$ = 1.5KOe

EXAMPLE 12

Same as Example 12

Tempering temperature/time: 500° C./200 hours
Result:
remanence Br = 9KG
coercive field strength $_JH_C$ = 5KOe

EXAMPLE 13

Same as Example 12
Tempering temperature/time: 500° C./200 hours
Result:
remanence Br = 9KG
coercive field strength $_JH_C$ = 5.8KOe

EXAMPLE 14

Same as Example 12
Tempering temperature/time: 600° C./200 hours
Result:
remanence Br = 9KG
coercive field strength $_JH_C$ = 1KOe

EXAMPLE 15

Starting alloy: 100g of $Sm_2(Co_{0.8}Fe_{0.1}Mn_{0.1})_{17}$
Sinter additive: 11g of (Sm 50 wt.%, Co 40 wt.%, Fe 5 wt.%, Mn 5 wt.%)
Grain size: 2.75 μm
Sinter temperature: 1155° C.
No homogenization annealing
Tempering temperature/time: 500° C./6 hours
Result:
remanence Br = 11.2KG
coercive field strength $_JH_C$ = 4KOe

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A rare earth permanent magent comprising an alloy consisting of:

$$RE_2(Co_{1-x-y}Fe_xTM_y)_{17+z}$$

wherein:
RE is at least one rare earth element;
TM is at least one transition element selected from the group consisting of chromium, manganese, titanium, tungsten and molybdenum;
$-2 \leqq z \leqq 1$;
$0.5 < (1-x-y) < 1$
$0.05 \leqq x \leqq 0.4$
$0.01 \leqq y \leqq 0.2$
wherein said rare earth permanent magnet is further characterized by possessing high values of coercive field strength, an ideal demagnetization curve and a remanence of more than 9KG and wherein said rare earth permanent magnet is prepared by the process which comprises mixing together a starting alloy of the composition $RE_2(Co_{1-x-y}Fe_xTM_y)_{17+z}$ and 8 to 14 wt.% of a samarium-rich sinter additive compound composed of 50–60 wt.% samarium and 40–50 wt.% of an alloy $Co_{1-x-y}Fe_xTM_y$ wherein both said starting alloy and said sinter additive are each in powder form of average grain size 2.0 to 10 μm; magnetically aligning the mix; compressing it to a greenling; sintering it to form a magnet; and subjecting said magnet to a heat treatment to 400° C.–600° C.

2. The permanent magnet of claim 1, wherein the rare earth (RE) element is samarium, or a mixture of samarium and a light rare earth element of atomic number 57–62, misch metal or mixtures thereof.

3. The permanent magnet of claim 1, wherein the average grain size of the material used to prepare the magnet is smaller than 3.0 μm.

4. The permanent magnet to claim 1, which has a predominantly single-phase structure.

5. A process for preparing a rare earth permanent magnet comprising an alloy consisting of:

$$RE_2(Co_{1-x-y}Fe_xTM_y)_{17+z}$$

wherein:
RE is at least one rare earth element;
TM is at least one transition element selected from the group consisting of chromium, manganese, titanium, tungsten and molybdenum;
$-2 \leqq z \leqq 1$
$0.05 \leqq x \leqq 0.4$
$0.01 \leqq y \leqq 0.2$
wherein said rare earth permanent magnet is further characterized by possessing high values of coercive field strength, an ideal demagnetization curve and a remanence of more than 9KG;
which comprises mixing together a starting alloy of the composition $RE_2(Co_{1-x-y}Fe_xTm_y)_{17+z}$ and 8 to 14 wt.% of a samarium-rich sinter additive compound composed of 50–60 wt.% samarium and 40–50 wt.% of an alloy $Co_{1-x-y}Fe_xTM_y$ wherein both said starting alloy and said sinter additive are each in powder form of average grain size 2.0 to 10 μm; magnetically aligning the mix; compressing it to a greenling; sintering it to form a magnet; homogenizing and annealing said magnet; and then subjecting said magnet to a heat treatment of 400° C.–600° C.

6. The method of claim 5, wherein the starting alloy is produced by melt-metallurgy, is then subjected to a stabilization annealing below the liquidus temperature and is then crushed.

7. The method of claim 5, wherein the starting alloy and the sintering additive are ground to an average grain size of from 2.0 to 5 μm.

8. The method of claim 5, wherein the greenling is sintered in the temperature range of 1110° C. to 1180° C. to form a magnet.

9. The method of claim 5, wherein the magnet, after the sintering treatment, is homogenization-annealed in the temperature range of from 1000° C. to 1100° C.

10. A method of claim 5, wherein the magnet is magnetized after being heat treated.

* * * * *